United States Patent [19]

Podosek

[11] Patent Number: 4,560,299

[45] Date of Patent: Dec. 24, 1985

[54] PRESENTATION FOLDER

[75] Inventor: Edward Podosek, Wilbraham, Mass.

[73] Assignee: Dennison National Company, Holyoke, Mass.

[21] Appl. No.: 597,422

[22] Filed: Apr. 6, 1984

[51] Int. Cl.[4] ..... B42F 3/02; B42F 13/00

[52] U.S. Cl. ..... 402/15; 402/75

[58] Field of Search ..... 402/14, 15, 18, 31, 402/58, 59, 500, 75; 24/153; 40/11 R, 44 R; 227/90

[56] References Cited

U.S. PATENT DOCUMENTS

| | | | |
|---|---|---|---|
| 176,641 | 4/1876 | Johns | 402/14 |
| 2,079,740 | 5/1937 | Hunter et al. | 402/18 |
| 2,570,166 | 10/1951 | Striker | 402/14 |
| 2,596,600 | 5/1952 | Rice | 402/15 |
| 2,609,580 | 9/1952 | Dixon | 402/14 |
| 2,637,326 | 5/1953 | Witz | 402/14 |
| 2,725,881 | 12/1955 | Goldman | 402/14 |
| 3,680,969 | 8/1972 | Gorman | 402/75 |
| 4,109,348 | 8/1978 | Olsson | 402/15 |
| 4,256,250 | 3/1981 | LeBlanc | 227/90 |

*Primary Examiner*—Robert L. Spruill
*Assistant Examiner*—Paul M. Heyrana, Sr.
*Attorney, Agent, or Firm*—Chapin, Neal & Dempsey

[57] ABSTRACT

A loose leaf presentation folder which has an outer cover with front and rear panels pivotable about a hinge line and an inner binder strip, which may either be a discrete component or part of the cover, includes a pair of narrow panels pivotable about a fold line. If discrete, the strip is affixed within the outer cover with its fold line superimposed on the hinge line of the cover. The opposed outer edge portions of the binder strip are provided with a plurality of transversely-spaced, metallic tabs. The binder strip and the tabs, disposed along one edge thereof, are each provided with a hole therethrough and along the other edge of the binder strip, each of the tabs includes elongated prongs which are bendable to fit through the hole in the opposite edge of the binder strip. In the manufacture of this folder, the metallic tabs are adhesively bonded along the opposed edges of a continuous binder strip, thereafter the tabs are die-cut to provide holes and prongs which form female and male loose leaf binder elements.

1 Claim, 6 Drawing Figures

Fig. 1.
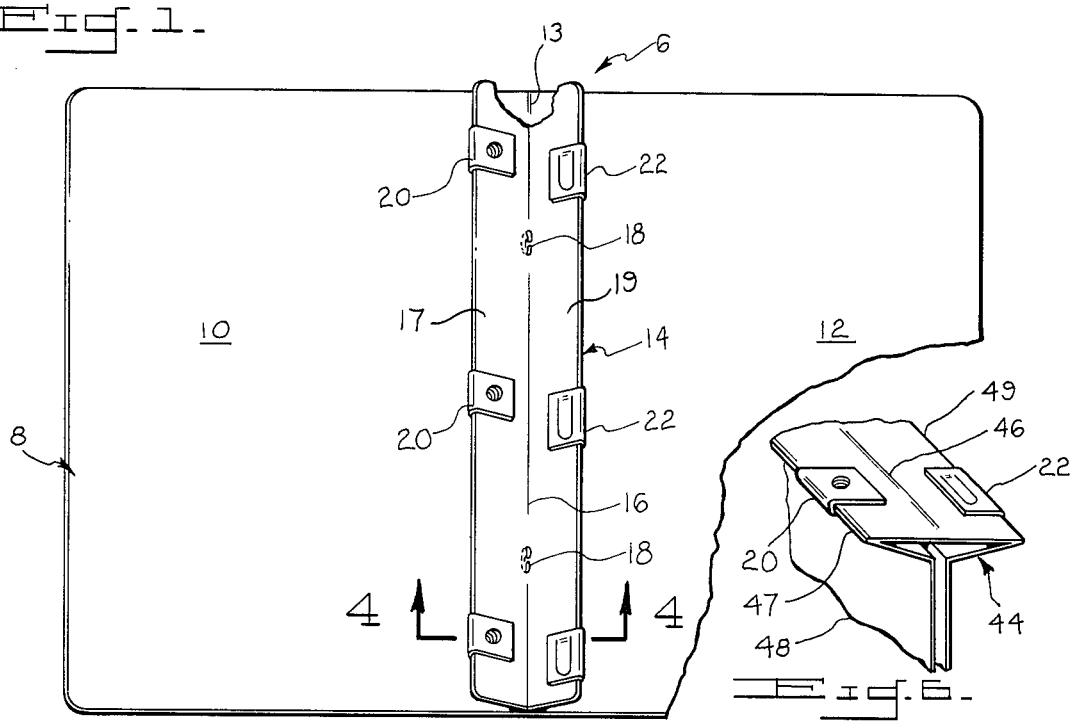
Fig. 6.
Fig. 2.
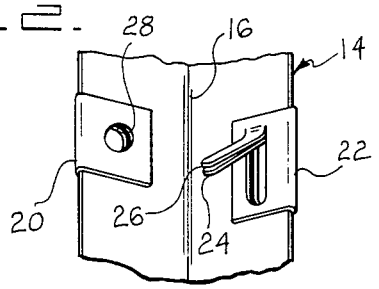
Fig. 3.
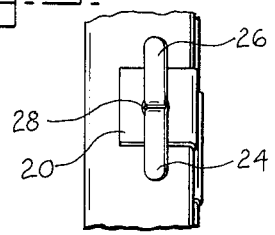
Fig. 4.
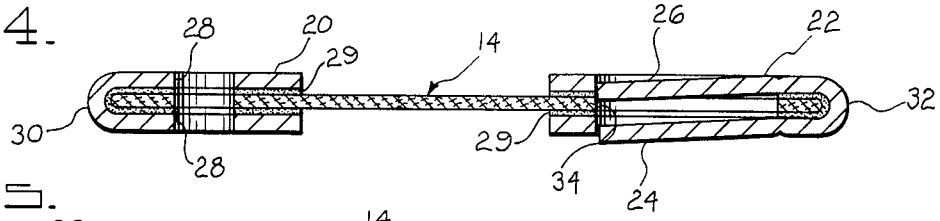
Fig. 5.
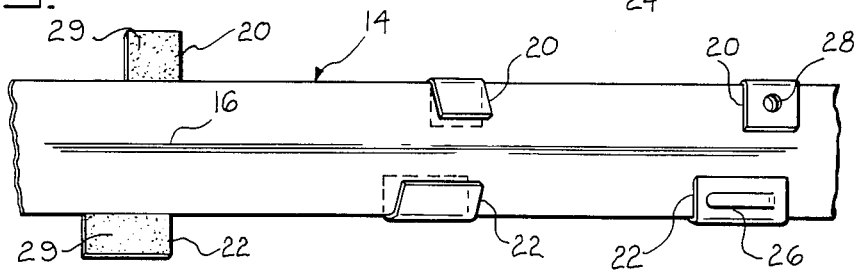

PRESENTATION FOLDER

BACKGROUND OF THE INVENTION

Loose leaf presentation folders of the general type to which this invention relates, include those such as disclosed in U.S. Pat. Nos. 2,289,949 and 3,172,409. In the former, the inner edge portion of the folder is cut to provide binder tongues or prongs and prong-receiving apertures. In the latter patent, spaced metallic fasteners, known in the trade by the trademark "DUO-TANG", are attached along the inner edge of the folder. "DUO-TANG" fasteners include prongs and prong-receiving eyelets affixed to the folder or binder strip by eyeleting machines having progressive dies with punch press equipment. The Moller U.S. Pat. No. 3,362,411 discloses plastic binder elements with elongated tongue portions and retaining slots. U.S. Pat. No. 3,604,076 discloses a variety of removable clip members having resilient foam backing which is compressible.

While loose leaf folders, of the type disclosed in the above-mentioned patents, are suitable for their intended purpose, they do not lend themselves to simple and economical manufacturing processes adapted to continuous and automated methods.

It is a principal object of this invention to provide a presentation folder of improved construction which is adaptable to a simple and economical fabricating method.

It is another object of this invention to provide an improved method for the manufacture of presentation folders.

It is a further object of this invention to provide a presentation folder having metallic reinforcing tabs which are adhesively bonded in spaced relation along the edges of a binder strip and die-cut to form the male and female binder elements of the folder.

The above and other objects and advantages of this invention will be more readily apparent from the following description read in conjunction with the accompanying drawing in which:

FIG. 1 is an overall perspective view of a presentation folder of the type embodying this invention;

FIGS. 2 and 3 are partial perspective views, on an enlarged scale, illustrating binder elements of the folder in two different operative conditions;

FIG. 4 is a section, on an enlarged scale, taken along line 4—4 of FIG. 2;

FIG. 5 is a perspective view which illustrates the sequence of steps used in the method of manufacturing folders of the type embodying this invention, and FIG. 6 is a partial perspective view which illustrates an alternate embodiment of the invention.

Referring in detail to the drawings in FIG. 1, a binder is shown generally at 6 comprising an outer cover 8 having front and rear panels 10 and 12 which are hinged for opening and closing the binder along a transversely extending hinge line 13. The cover of the folder may be fabricated of any suitable sheet material which is resiliently flexible, such as stiff paper, fiberboard, synthetic plastic or a combination of these materials.

Disposed within the cover of the folder, is a relatively narrow and discrete binder strip 14 which, in effect, is a narrower version of the outer folder itself. The binder strip may be the same or a different type of sheet material as the cover and includes a central hinge or fold line 16 and two rectangular panels or leaves 17 and 19. The binder strip is affixed to the folder by any suitable means, such as staples 18 or other fasteners with the hinge line 16 of the strip 14 in registration with the hinge line 13 of the outer cover 8. In an alternative embodiment shown in FIG. 6, the cover per se may be folded and scored to provide a binder strip portion 44 integral with the cover.

As shown, loose leaf binder elements 20 and 22 are disposed in spaced relation along opposed outer edge portions of the panels or leaves 17 and 19. The binder elements 20 disposed along the outer edge of the leaf 17 are the female components of the binder system and each includes a central hole 28 (FIG. 2). The male components 22 are disposed along the outer edge portion of the leaf 19 and these include tongues or prongs as shown at 24 and 26 in FIG. 2 which are adapted to interfit with the hole 28 of the female components, as shown in FIG. 3. The binder elements 20 and 22 are preferably formed of a relatively thin, metallic sheet material or foil which is sufficiently pliable so that it can be repeatedly bent without breaking.

The inner surfaces of the tabs are preferably coated with a "hot-melt" adhesive, as shown at 29 in FIG. 5, so that the tabs can be firmly and permanently bonded onto the outer surfaces of the binding strip 14. The fastener elements, in the embodiment shown, are of generally rectangular configuration and are of sufficient width so that they can be reversibly folded around the outer edges of the binder strip 14 to form a three-ply laminar structure. Alternatively, the binder elements 20 and 22 may be about one-half the width shown for application as a single-ply (not shown) on only one side of the panels 17 and 19. In both these embodiments, the inner surface of the tab is coated with a suitable adhesive.

As best illustrated in FIG. 5, a continuous length of fibrous sheet material, such as a cardboard or a fiberboard which is relatively stiff but yet resilient, is advanced past a number of sequential work stations for application of the binder elements. In accordance with this invention, the first step in the process embodying this invention is the fabrication of a binder strip 14 or binder cover folded and scored to include an integral binder strip portion, as shown at 44 in FIG. 6. Next is the placement of adhesive-coated flat, metallic tabs 20 and 22 along opposite edge portions of the binder strip 14 so that they will register or overlap when the binder strip is folded along line 16. The tabs 20 and 22 are then reversibly folded or bent over the edge of the strip 14 so that the sheet material is securely clamped therebetween. Heat is thereupon applied to the outer surface of the tabs to cause thermal activation of the adhesive. While it is preferable to employ a "hot-melt" adhesive, it is within the purview of this invention to employ any adhesive of a suitable type, such as pressure-sensitive or a solvent type adhesive which will effect a permanent and strong bond. Following the bonding of the tabs along the outer edge of the binder strip, a die-cutting step is used to provide the holes 28 by cutting through the two outer layers of metal and the paper layer or layers bonded therebetween. Simultaneously, the prongs or tongues 24 and 26 are cut in to form the male components 22. The prongs are cut so that their longer dimension extends in a direction generally parallel to the crease line 16. Also, the inner or fixed ends of the prongs are located directly opposite the center of the holes 28. Finally, the continuous strip 14 is severed to provide individual binder strips to be stapled within an outer cover 8, as shown in FIG. 1.

In FIG. 6 is shown an alternative structure for forming a presentation folder embodying my invention. A cover material, such as 48, in folded and scored in such a way as to provide an integral accordion-type hinge and binder strip construction, as illustrated at 44. Panels 47 and 49 are or reversibly-folded, two-ply construction and are defined by a hinge line 46. The binder elements 20 and 22 are applied along opposed edges of these folded, two-ply panels in the same general manner as described above.

In using the binder or folder 6, it is only necessary to bend the prongs 24 and 26 outwardly of the plane of the binder strip 14, as best illustrated in FIG. 2. With the prongs so oriented upwardly, loose leaf pages may be fitted onto the prongs in generally the same manner as with any binder. With the pages fitted onto the upstanding prongs, the binder leaf 17 may be folded over the inner edges of the loose leaf pages with the holes 28 thereof receiving the outer ends of the upright prongs. When the loose leaf pages are clasped between the inner surfaces of the leaves 17 and 19 of the binder strip 14, or panels 47 and 49 of the integral construction 44, the outer ends of the prongs may be bent outwardly in the same or opposite directions, as indicated in FIG. 3. In this manner, the loose leaf sheets are securely and neatly bound within the folder. To remove the sheets or insert additional sheets to the folder, it is simply a matter of again bending the prongs 24 and 26 upwardly and disengaging the female tabs 20 therefrom. Thereupon, loose leaf sheets may, as desired, be removed or added in the usual manner.

While the illustrated embodiment of this invention discloses male tabs of two-ply construction, it will be recognized that single-ply tabs may also be used. In the latter case, instead of prongs 24 and 26, as illustrated in FIG. 2, there would be a single prong which would, of course, serve the same general purpose.

Having thus described this invention, what is claimed is:

1. Loose leaf folder having a cover with hinged front and back cover panels and a binder strip disposed within the folder comprising two narrow panels defined by a hinge line and tabs of metallic foil bonded in laterally spaced, corresponding relation along opposed outer edge portions of said narrow panels, each of the tabs disposed along one edge of the strip having a hole through the tab and the underlying portion of the strip, each of the tabs disposed along the outer edge of said strip including a pair of superimposed, elongated, bendable prongs, said tabs including portions which are reversibly folded over opposed outer edge portions of said strip and being bonded with a heat-responsive adhesive coating to the opposite surfaces of said binder strip, said prongs being dimensioned to fit through the hole in an opposite tab to releasably retain loose leaf sheets within said folder with their perforated edge portions retained by the interengagement of said prongs and the holes in said opposite tabs, said bendable prongs having their longer dimension disposed parallel to the fold line of the binder strip.

* * * * *